United States Patent [19]

Ciofalo

[11] 4,038,552

[45] July 26, 1977

[54] LUMINOUS SAFETY DEVICE

[76] Inventor: Anne Louise Ciofalo, 310 Lakeshore Drive, Haworth, N.J. 07641

[21] Appl. No.: 696,781

[22] Filed: June 16, 1976

[51] Int. Cl.[2] ..... F21K 2/00

[52] U.S. Cl. ..... 250/462; 116/63 P; 116/124 R

[58] Field of Search ..... 350/98, 97; 250/464, 250/462, 466; 116/28 R, 63 P, 124 R, DIG. 44

[56] References Cited

U.S. PATENT DOCUMENTS

| | | | |
|---|---|---|---|
| 1,361,380 | 12/1920 | Gay | 250/464 |
| 2,342,005 | 2/1944 | Mittag | 250/462 |
| 3,694,051 | 9/1972 | Dian | 350/97 |
| 3,950,076 | 4/1976 | Carlson | 350/98 |

*Primary Examiner*—S. Clement Swisher
*Assistant Examiner*—Denis E. Corr
*Attorney, Agent, or Firm*—Joel Halpern

[57] ABSTRACT

A safety device consists essentially of at least one octagonal plate which is provided on the opposed faces thereof with a luminous or light-reflective material. Each such plate is given connecting means cooperable to detachably secure the device to a selected object such as a garment worn by a person, an umbrella carried by such person or a collar worn by a pet animal. In one of the preferred forms of the invention the device includes a pair of plates connected integrally along adjacent edges by a living hinge. In such form the device is preferably made of a synthetic plastics material and is molded in a single step.

3 Claims, 6 Drawing Figures

LUMINOUS SAFETY DEVICE

BACKGROUND OF THE INVENTION

The present invention relates to safety devices and more particularly to safety devices which are luminous or light-reflective and are adapted to be worn by a person or animal, such devices being detachable and selectively interchangably worn.

The hazards inherent in the crossing of thoroughfares at night or during inclement weather are well known. Pedestrians are frequently not seen or are only dimly perceptible by motorists under such conditions. They are often the victims of vehicular accidents as a consequence of such conditions of poor visibility. Owners of pet animals, as is well known, customarily walk such animals during hours of dusk and darkness and, therefore, are especially vulnerable to accidents as they walk along the roadside. Similarly, joggers are generally found plodding their way along the roadway in the early morning and evening hours of dusk and darkness as well as at other times when conditions of poor visibility prevail. It will also be appreciated that young children often walk to school or wait for buses along the sides of streets and highways under the same hazardous conditions described above. Due to their immaturity and innocence they constitute a substantial proportion of the traffic accident statistics compiled each year. To date there are no safety devices available which are portable interchangable, and which will afford the desired degree of protection for these persons and their pet animals.

It has already been known to provide construction workers, traffic policemen, crossing guards and the like, who perform their services along roadways, with a variety of safety equipment. Typical are the luminous jackets and gloves, sashes, flashing and rotating warning lights and lanterns intended to alert passing motorists of their presence. To some extent these devices have served to reduce the frequency of vehicular accidents involving such persons. However, such safety equipment is either expensive, must be maintained in a fixed location, or cannot be employed interchangably in different situations. Thus, there does not exist a safety device which can be worn interchangably by a jogger, an individual walking in the rain carrying an umbrella, a person walking his pet animal, or by a pet animal, all of whom are often exposed to the risk of personal injury as outlined above.

SUMMARY OF THE INVENTION

It is one object of the invention to provide a safety device which can be worn interchangably by joggers, persons walking a pet animal, or by the animal itself and which is adapted to alert passing motorists to the presence of the person or animal wearing the device.

It is another object of the invention to provide a safety device which is of extremely simple construction and can thus be marketed at low cost to prospective users so as to encourage its widespread purchase and adoption with a consequent reduction in vehicular accidents involving pedestrians and animals at times when, due to conditions of poor visibility, the probability of such accidents is greatest.

It is still another object of the invention to provide a safety device of the character described which is so configured and constructed as to capitalize upon certain psychological factors peculiar to motorists.

Other objects and advantages of the invention will become readily apparent from the following description of the invention.

According to the invention there is provided a safety device comprising at least one octagonal plate having on the opposed faces thereof a luminous or light-reflective material, said plate having separable and cooperable connecting means for securing same selectively and detachably to selected objects.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
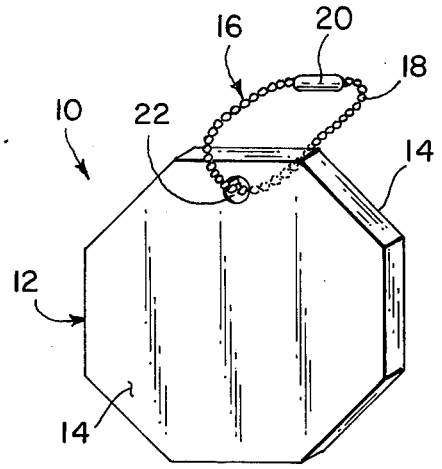
FIG. 1 is a perspective view of one embodiment of the safety device of the invention.

Referring to the drawings there is shown, as identified generally by reference numeral 10, a safety device constructed in accordance with the invention. The device comprises at least one plate 12 having an octagonal configuration. Each such plate is provided on the opposed faces thereof 14 with a luminous material. The term luminous, as used herein, is intended to refer to the characteristic of emitting, transmitting or reflecting light or radiant energy. The material may be of any known and commercially available chemical composition. Typical of the class of materials which may be employed are the reflex-reflecting coating materials disclosed in U.S. Pat. Nos. 2,407,608; 2,403,752; 2,379,741 and 2,326,624. Also utilizable is the reflective substance sold commercially under the trade name "Scotchlite". Such luminous materials may be applied to the plates in any conventional manner as may be expedient in the circumstances. Thus, in the event the plates are formed of a synthetic plastics material it is within the contemplation of the invention to coat the opposed faces of the plates subsequent to the molding thereof. Alternatively, if the material is susceptible to being incorporated into the resinous molding powder prior to the molding step it may be incorporated in this manner. Desirably the luminous material is colored red or yellow although the invention is not limited to the use of plates which have been prepared so as to exhibit any specific color. One advantage of the invention resides in the octagonal configuration of the plates. This configuration has been adopted throughout the U.S. and in many foreign countries for stop signs which are posted along highways as a visual traffic signal for motorists. Such signs are generally colored red. The adoption of such a configuration for the safety device of the invention capitalizes upon the subliminal sensitivity of the motorist to such safety signals and tends to accelerate a response to the safety device. The use of the color red serves to further stimulate the response of the motorist. The result is a safety device which is exceptionally effective in alerting motorists to the presence of the individual or animal wearing the device.

Figure 5:
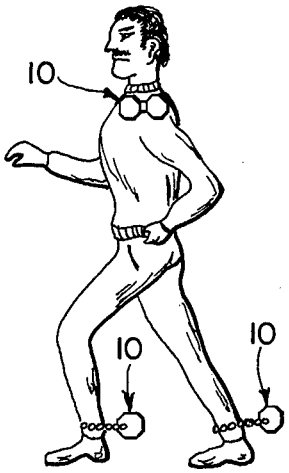
FIG. 5 is a perspective view of a jogger wearing the safety device of the invention upon the shoulders of a sweatshirt and upon his ankles.

The safety device includes connecting means 16 which are separable, e.g. formed in pairs of cooperable elements, so as to permit the detachable securing of the device to the selected object which may be a sweatshirt, umbrella handle or dog collar. As shown in FIG. 1 the connecting means may take the form of a chain 18 the free ends of which may be joined within a clasp 20 of known construction. The provision of the device in this form renders its utility especially convenient with articles having a handle such as an umbrella. Such device may also be easily attached having a handle such as an umbrella. Such device may also be easily attached to the collar of a dog. The chain may be worn as a bracelet so as to affix the device to the wrist or ankle of a jogger as depicted in FIG. 5. It will be understood, of course, that the invention may take other forms to suit the desires of the person to be protected. An aperture 22 in the plate is dimensioned to slidably receive the chain.

Figure 2:
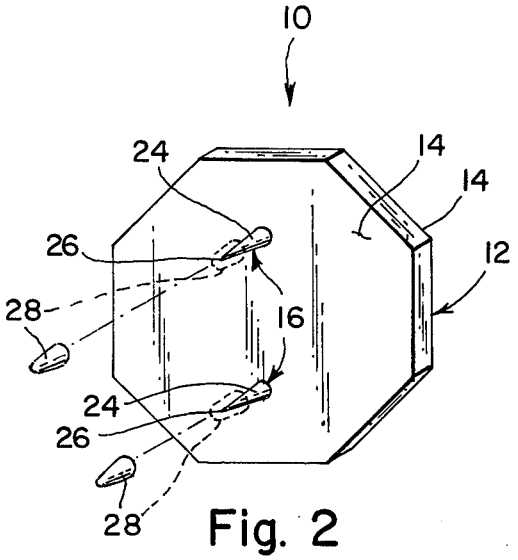
FIG. 2 is a perspective view of another embodiment of the safety device of the invention.
Figure 3:
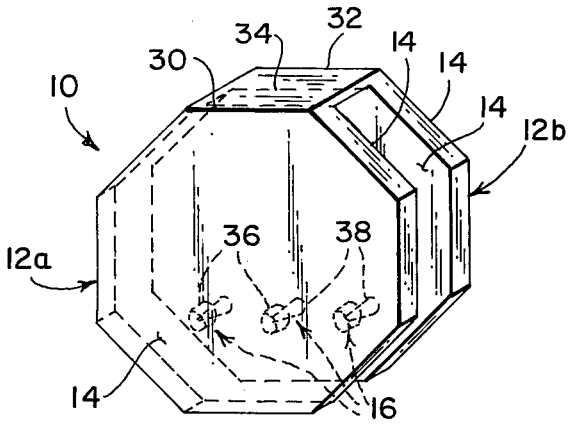
FIG. 3 is a perspective view of still another embodiment of the safety device of the invention.
Figure 4:
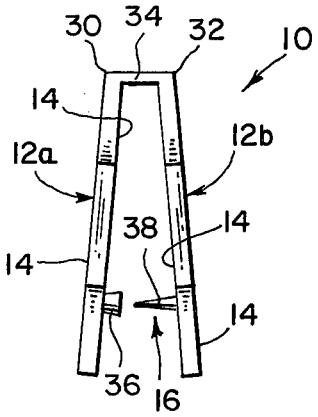
FIG. 4 is a side view of the safety device shown in FIG. 3.

FIG. 2 illustrates the safety device of the invention adapted specially to be worn on the front or back of a sweater or other garment. The device is given one or more tapered pins 24 which are preferably formed integrally with the plate.Such pins, due to their sharply tapered or pointed ends, can easily penetrate the fabric of the garment. Once the pin or pins have entered the fabric a cooperable connecting element 28 is positioned over the end 26 of the pin and is held in place such as by a force fit to affix the safety device in the selected position. Element 28 thus is in the form of a socket and receives the pin releasably.

One of the presently preferred embodiments of the invention is shown inFIGS. 3 and 4. Such device includes a pair of plates 12*a* and 12*b* connected along adjacent edges 30, 32 by means of a living hinge 34 which is desirably formed integrally with the plates or joined to the plates subsequent to their formation. One of the plates is provided with a female connecting element 36 or with a plurality of such elements. The other plate is given a corresponding number of cooperable mating connecting elements 38. The connecting elements 36, 38 may be the same as employed with the device shown in FIG. 2 except that they are formed preferably integrally with the plates.

The plates, as stated above, are preferably molded of a synthetic plastics material such as one of the many resins which are currently available commercially. However, it within the scope of the invention to employ a sheet metal as the material for formation of the plates as well as any other material which lends itself for the purpose and will accept the light emitting or reflective material. Since the invention does not reside in the use of any specific luminous material, and allows of the use of any appropriate known compound or composition, the present specification will not be encumbered with a detailed description of the chemical composition or methods of applying such materials. Typical coating materials have been mentioned previously. It is sufficient that the material can be applied to or incorporated in the plates of the device so as to adhere thereto and retain its luminous characteristics even in inclement weather and over a relatively wide temperature range.

As depicted in FIG. 5, the device of the invention may be secured to the sweatshirt of a jogger in the form of epaulettes on the shoulders thereof so as to be conspiculously displayed. The device may also be worn, if so desired, at the ankle level by employing either of the devices shown in the figures of the drawings. As illustrated in FIG. 5 the device with the chain has been employed.

Figure 6:
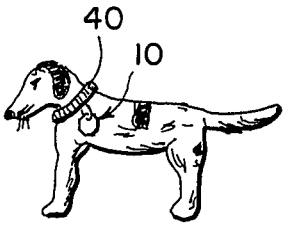
FIG. 6 is a perspective view of a pet animal having the safety device of the invention affixed to its collar.

FIG. 6 shows the device of FIG. 1 attached to the collar 40 of a dog. However, as will be appreciated, any of the devices can be used as may be found most convenient and effective. Certain individuals may prefer that the plate be movably mounted on the collar whereas other individuals may prefer that the device be maintained in fixed relation to the collar to achieve maximum visibility.

From the above description of the invention it will be seen that a safety device has been provided which is extremely simple in construction, can be used interchangably by man and animal alike, and which can serve as an effective warning device to attract the attention of passing motorists so as to minimize the hazards of foot travel along roadways and across thoroughfares.

Numerous alterations of the structure herein disclosed will suggest themselves to those skilled in the art. However, it is to be understood that the present disclosure relates to preferred embodiments of the invention which are for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A safety device comprising a pair of octagonal plates and a living hinge secured therebetween along adjacently disposed edges thereof to thereby integrally and hingedly connect said plates, said plates and said hinge element being formed in a single step by a molding procedure, a luminous material being provided on at least the opposed outer faces of said plates, and separable cooperable connecting means for detachably securing said plates to a selected object.

2. A safety device according to claim 1, wherein at least one connecting element is carried integrally by each plate of said pair of plates, the connecting elements on a first of said plates being cooperable with the corresponding connecting elements on the second of said pair of plates to releasably connect said plates.

3. A safety device according to claim 1, wherein an aperture is formed in each said plate, and a chain element is threaded through said apertures, a clasp being provided for securing the ends of said chain therein.

* * * * *